US006174004B1

(12) United States Patent
Picard et al.

(10) Patent No.: US 6,174,004 B1
(45) Date of Patent: Jan. 16, 2001

(54) MORTISE LATCH AND EXIT DEVICE WITH CONCEALED VERTICAL RODS

(75) Inventors: Daniel J. Picard, Oakville; Donald T. Shamp, Northford, both of CT (US)

(73) Assignee: Sargent Manufacturing Company, New Haven, CT (US)

( * ) Notice: Under 35 U.S.C. 154(b), the term of this patent shall be extended for 0 days.

(21) Appl. No.: 09/317,053

(22) Filed: May 24, 1999

Related U.S. Application Data

(63) Continuation-in-part of application No. 09/236,778, filed on Jan. 22, 1999.

(51) Int. Cl.[7] ..... E05C 1/12

(52) U.S. Cl. ..... 292/165; 292/341.15; 292/332; 292/333

(58) Field of Search ..... 292/340, 341.15, 292/341.17, 332–335, DIG. 72, DIG. 21, 165, 169, 92; 70/131, 142, 92, 486, 487, 157

(56) References Cited

U.S. PATENT DOCUMENTS

| | | | | |
|---|---|---|---|---|
| 444,730 | | 1/1891 | Shinn | 292/34 |
| 842,270 | * | 1/1907 | Taylor | 70/486 |
| 1,126,560 | * | 1/1915 | Page | 70/157 |
| 1,158,845 | * | 11/1915 | Prinzler | 70/157 |
| 1,346,670 | | 7/1920 | Page | 70/92 |
| 1,850,222 | | 3/1932 | Carlson | 292/33 |
| 2,019,528 | | 11/1935 | Ellison | 49/248 |
| 2,029,901 | | 2/1936 | Voight | 292/92 |
| 2,056,537 | | 10/1936 | Schatzlein | 292/341.17 |
| 2,107,300 | * | 2/1938 | Kilpatrick | 70/142 |
| 2,505,190 | | 4/1950 | Kulbersh | 292/78 |
| 2,594,253 | | 4/1952 | Vander Veer | 292/92 |
| 3,375,687 | * | 4/1968 | Faster | 70/150 |
| 3,420,561 | * | 1/1969 | Russell et al. | 292/165 |
| 3,621,686 | * | 11/1971 | Klein . | |
| 3,672,714 | * | 6/1972 | Schultz | 292/34 |
| 3,808,849 | * | 5/1974 | Alexander | 70/149 |
| 3,819,213 | | 6/1974 | Vanderburgh | 292/21 |
| 3,999,411 | * | 12/1976 | Kambic | 70/144 |
| 4,099,753 | | 7/1978 | Gwozdz et al. | 292/177 |
| 4,262,504 | * | 4/1981 | Inoue | 70/151 R |
| 4,283,882 | | 8/1981 | Hubbard et al. | 49/141 |
| 4,311,329 | | 1/1982 | Kral | 292/92 |
| 4,322,958 | * | 4/1982 | Eigmeier | 70/107 |
| 4,596,411 | * | 6/1986 | Geringer et al. | 292/144 |
| 4,840,050 | * | 6/1989 | Gotanda | 70/107 |
| 4,961,330 | | 10/1990 | Evans | 70/21 |
| 5,061,022 | | 10/1991 | Meriwether | 312/324 |

(List continued on next page.)

*Primary Examiner*—Lynne H. Browne
*Assistant Examiner*—John B. Walsh
(74) *Attorney, Agent, or Firm*—DeLio & Peterson, LLC

(57) ABSTRACT

A mortise latch and exit device includes active and passive mortise latch mechanisms with corresponding concealed vertical rods operated by links mounted within the mortise latch mechanisms. The mortise latch mechanisms latch double doors at a center point between the doors and at top points between each door and the door frame. Lower vertical rods may also be used to latch at bottom points between the doors and the floor. The active and passive mortise latch mechanisms are operated by corresponding push handle mechanisms and rotary handles. The mortise latch mechanisms cooperatively interact so that either door may be opened first, and either door may be closed first, without regard to the position of the other door. The active mortise latch mechanism includes a latch bolt and an activation bolt arranged so that one bolt is retracted when the other is extended, except when the doors are being opened or closed, when both bolts are retracted. The active mortise latch mechanism automatically retracts the latch bolt when the doors are not aligned and automatically extends the latch bolt when the doors are aligned. The passive mortise latch mechanism ejects the latch bolt as needed to allow the passive door to be opened first.

32 Claims, 6 Drawing Sheets

U.S. PATENT DOCUMENTS 5,498,038 3/1996 Simon et al. ..... 292/36
5,588,686 12/1996 Riley et al. ..... 292/92
5,757,269 * 5/1998 Roth et al. ..... 340/542
5,941,581 * 8/1999 Heithe ..... 292/332

* cited by examiner

MORTISE LATCH AND EXIT DEVICE WITH CONCEALED VERTICAL RODS

This application is a continuation-in-part of Ser. No. 09/236,778 filed Jan. 22, 1999.

BACKGROUND OF THE INVENTION

1. Field of the Invention

This invention relates to exit devices using latch mechanisms mortised into the door, particularly mortise latch mechanisms used in combination with vertical rod latch assemblies. More specifically, this invention relates to mortise latch mechanisms suitable for use in both single and double door installations which have a center latching point and which use vertical rods that are concealed within the door to latch the door at the top and/or bottom.

2. Description of Related Art

Exit devices using vertical rod mechanisms to latch the door at the top and bottom are widely used in public buildings, particularly where provision must be made for rapid operation in an emergency to evacuate the building. Such devices usually employ a push handle, a push bar, an emergency push plate or a similar type of opening mechanism on the door interior that operates when pressure is applied towards the door. This allows the exit device to open quickly and reliably even when a large number of people trying to exit the building in an emergency.

Vertical rod exit devices are often used on double door installations where both doors can be opened to provide a large and unobstructed exit. Conventional vertical rod exit devices, however, suffer from various problems. Typically, the vertical rod exit device will have two externally mounted vertical rods. One vertical rod will extend upward from the push rail to a latch mechanism mounted near the upper edge of the door. The upper latch will engage a strike plate set into the frame above the door. A second vertical rod will extend vertically downward to a latch mechanism mounted near the bottom edge of the door. The lower latch will engage a strike plate set into the floor.

One problem with this design is that the downwardly extending rod, when surface mounted on the door, will interfere with the use of the door. The lower rod tends to catch and obstruct wheelchairs and carts passing through the door, particularly when the door is provided with an automatic closure device that continuously urges the door towards the closed position. This pressure forces the face of the door and the surface mounted lower vertical rod into the path of the cart or wheelchair. A solution to this is to mount the vertical rods inside the door. Mounting the rods inside the door makes it difficult to adjust the rods, however, and some internal vertical rod designs require that the door be removed in order to adjust the rods.

Another difficulty with the lower vertical rod is that the bottom latch must engage a strike plate in the floor. The floor mounted strike plate poses a tripping hazard which is a liability concern.

Removal of the lower rod, however, compromises the security of the door as the door is now latched only by the upper latch. The length of the door allows significant force to be exerted against the single upper latch. One solution to this security problem is to use a center latch mechanism in combination with the upper vertical rod latch. While this arrangement (a single vertical rod latch at the top and a center latch) is effective in single door applications, the center latch causes difficulties in double door applications.

The principal difficulty with prior art double door applications has been in coordinating operation of the center latch when the two doors are used independently. In double door designs with only vertical rod latches and no center latch, the double doors may be identical mirror images, with each one operating independently of the other. In double door designs using a center latch, however, one of the two doors will be an active door, including a latch bolt which extends out from the active door and engages an opening in the passive door. It is this active latch bolt that causes the difficulty because it needs to be retracted when either door is being opened or closed.

In one design for center latched vertical rod double doors, the latch bolt on the active door is retracted by the opening mechanism on the active door (usually a push rail) and is spring loaded with an inclined strike surface so that it automatically retracts when the active door closes against an angled strike plate on the closed passive door. In this design, the passive door is manually latched in position at the top and bottom and can only be opened or closed when the active door is being held open. Because the passive door lacks a push rail opening mechanism, and cannot be closed when the active door is closed, it cannot function as a conventional door and is of limited value in an emergency.

Other improved designs allow the passive door to be opened regardless of the state of the active door, as needed in an emergency, but the passive door still cannot be closed unless the active door is held open. Thus, these designs do not allow the passive door to be used for normal operation. Heretofore, all double door vertical rod systems employing a center latch mechanism have had some limitation on the order of opening or closing the passive door relative to the open or closed position of the active door.

Bearing in mind the problems and deficiencies of the prior art, it is therefore an object of the present invention to provide a mortise style center latch mechanism suitable for use in single and double door applications and for use in combination with single or double vertical rod latch mechanisms which allows each door of a double door combination to be operated independently without regard to the open or closed position of the other door.

Another object of the present invention is to provide a mortise style center latch mechanism which can operate a concealed vertical rod located inside the door.

Still another object of the present invention is to provide a mortise style center latch mechanism which allows a concealed vertical rod located inside the door to be adjusted vertically without removing the door.

Yet another object of the present invention is to provide a mortise style center latch mechanism which can operate a single vertical rod, or dual vertical rods that are located inside the door.

A further object of the present invention is to provide a mortise style center latch mechanism which can be operated by a rotary handle on one side of the door and a push handle or push plate on the opposite side of the door.

SUMMARY OF THE INVENTION

The above and other objects, which will be apparent to those skilled in the art are achieved in the present invention which relates to an active mortise latch mechanism that includes a case, a latch bolt mounted in the case for motion between an extended and a retracted position, the latch bolt being adapted for retraction by a handle, an activation bolt mounted in the case for motion between an extended and a retracted position and a retractor mounted in the case and connected between the latch bolt and the activation bolt to retract the latch bolt when the activation bolt is extended.

An activation bolt spring is connected to extend the activation bolt when the activation bolt is not obstructed and a vertical rod retractor link is mounted in the case, with the vertical rod retractor link being operably connected to the latch bolt to retract a vertical rod when the latch bolt moves to the retracted position. This construction causes the latch bolt to extend when both the active and passive doors are closed and to retract when either door is open.

In one aspect of the invention the retractor includes first and second relatively movable portions, the first retractor portion contacting the latch bolt and the second retractor portion contacting the activation bolt. The relative motion between the two portions allows the latch bolt to be pushed to the retracted position when the activation bolt is also in the retracted position.

In a single door application the latch bolt from the active mortise latch mechanism extends into an opening in a strike plate mounted in the door frame. In the most highly preferred embodiment, however, the active mortise latch mechanism operates in combination with a passive mortise latch mechanism mounted in a passive door and the latch bolt extends into an opening in the case of the passive mortise latch mechanism.

The passive mortise latch mechanism includes a pusher slide movable between receiving and ejecting positions and the pusher slide has a pusher surface for pushing and ejecting the latch bolt of the active mortise latch mechanism from the opening in the case of the passive mortise latch mechanism when the pusher slide is in the ejecting position. The pusher slide is operated by at least one, and preferably two, pivot arms pivotally mounted to the case of the passive mortise latch mechanism.

The preferred design for the active mortise latch mechanism includes a vertical rod mount for connection to the vertical rod. The vertical rod retractor link engages the vertical rod mount and retracts it to retract the vertical rod when the latch bolt moves to the retracted position. Most preferably, the vertical rod mount is adjustable, allowing the length of the rod to be adjusted. In one aspect of the invention, the vertical rod retractor link includes a fork having a pair of arcuate tines acting on projections located on opposite sides of the vertical rod mount for engaging and retracting the vertical rod mount.

The vertical rod mount may be constructed in two parts, one part being internally threaded to engage threads on the vertical rod, and the other part being attached by a pin to the first part, the pin being removable to allow the first part to be rotated and adjust the length of the vertical rod. A gripping surface of vertical grooves may be provided on the outside of the first part to facilitate rotating that part during adjustment of the vertical rod.

In another aspect of the invention, the active and passive latch mechanisms may be operated by push handles on the interior side and rotary handles on the exterior side, the rotary handles turning retractor fingers rotationally attached to the latch mechanism case which actuate the lock.

In the design of the active mortise latch mechanism, the latch bolt includes a tail engageable by an operating member extending into the case from a push handle located on one side of the case and the latch bolt retractor finger is engageable by a shaft extending into the case from a rotary handle located on an opposite side of the case from the push handle. Preferably, the latch bolt tail is moveable by an operating member extending into the case from the push handle without moving the latch bolt retractor finger. This allows the push handle to open the door, even where the rotary handle is locked and cannot turn.

For high security applications, the active and/or passive mortise latch mechanisms may include second vertical rod retractor links for retracting second vertical rods. In the active design, the second vertical rod retractor link is operably connected to the latch bolt to retract the second vertical rod when the latch bolt moves to the retracted position. In each of the passive and active designs, the second vertical rod retractor link is driven by the first vertical rod retractor link to retract the second vertical rod when the first vertical rod retractor link retracts the first vertical rod. The second vertical rods are preferably connected to corresponding second vertical rod mounts that are identical to the first vertical rod mounts.

The passive mortise latch mechanism includes a case, an opening in the case for receiving the latch bolt of the active mortise latch mechanism, and a pusher slide movable between receiving and ejecting positions. The pusher slide has a pusher surface for pushing and ejecting the latch bolt of the active mortise latch mechanism from the opening in the case when the pusher slide is in the ejecting position. The passive mortise latch mechanism further includes a vertical rod retractor link mounted within the passive case, the vertical rod retractor link in the passive case being operably connected to retract a passive vertical rod when the pusher slide moves to the ejecting position.

The passive mortise latch mechanism has a pusher slide spring connected to urge the pusher slide towards the receiving position and an operating opening in the case of the passive mortise latch mechanism adapted to receive an operating member from a push handle. The passive mortise latch mechanism further includes at least one pivot arm pivotally mounted to the case of the passive mortise latch mechanism, the pivot arm having a first end for operation by an operating member from the push handle located on one side of the passive case and a second end for operating the pusher slide.

BRIEF DESCRIPTION OF THE DRAWINGS

The features of the invention believed to be novel and the elements characteristic of the invention are set forth with particularity in the appended claims. The figures are for illustration purposes only and are not drawn to scale the invention itself, however, both as to organization and method of operation, may best be understood by reference to the detailed description which follows taken in conjunction with the accompanying drawings in which:

DESCRIPTION OF THE PREFERRED EMBODIMENT(S)

In describing the preferred embodiment of the present invention, reference will be made herein to FIGS. 1–6 of the drawings in which like numerals refer to like features of the invention.

Figure 1:
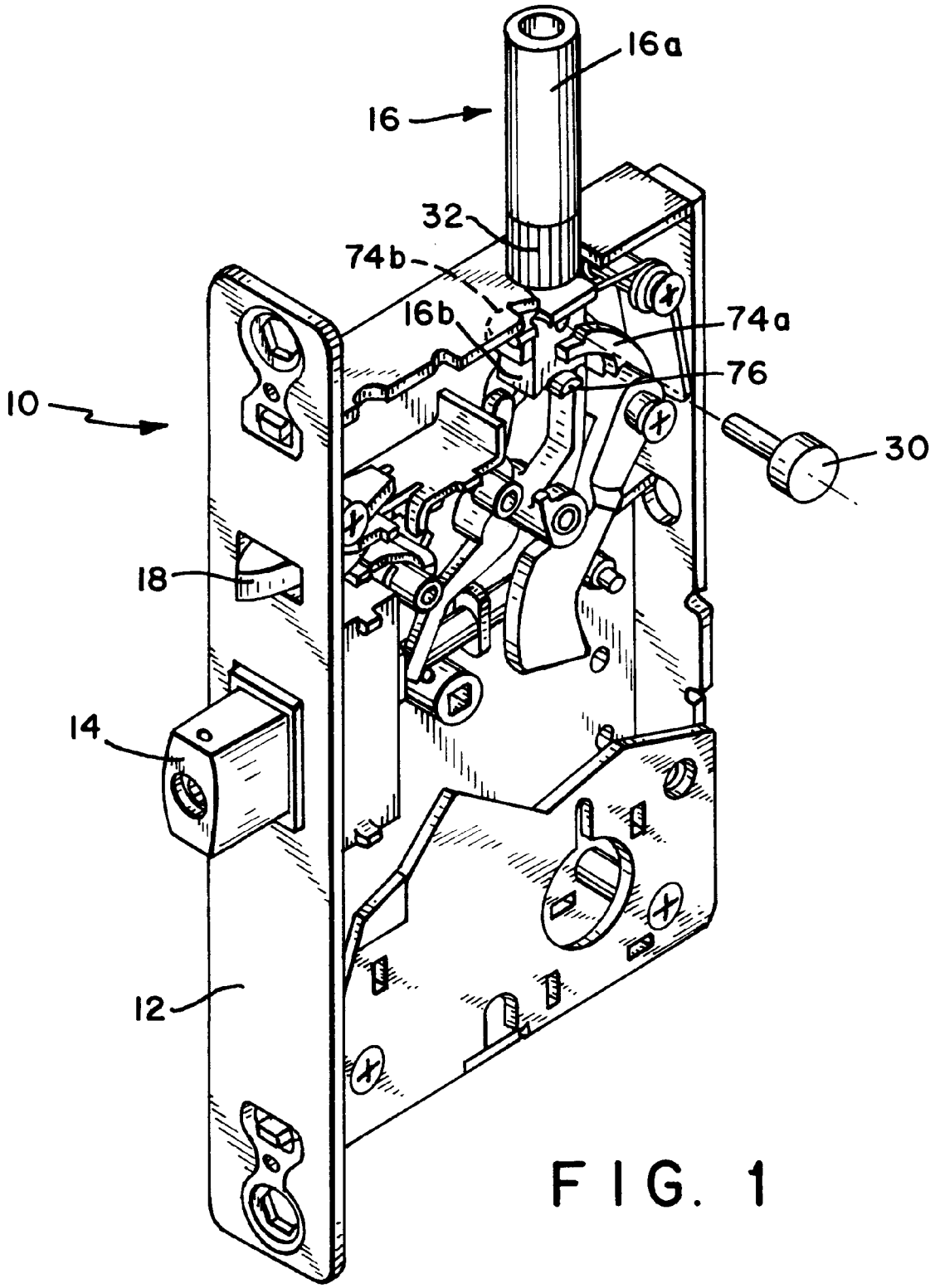
FIG. 1 is a perspective view of an active mortise latch mechanism according to the present invention showing the mechanism in an embodiment having a single upper vertical rod. A portion of the front wall of the case has been cut away for clarity. The mechanism is illustrated in the condition that occurs when the door is closed, i.e., with the latch bolt and upper rod extended and the activation bolt blocked in the retracted position by a door frame (in a single door installation) or the passive latch mechanism (in a double door installation - see FIG. 2).
Figure 2:
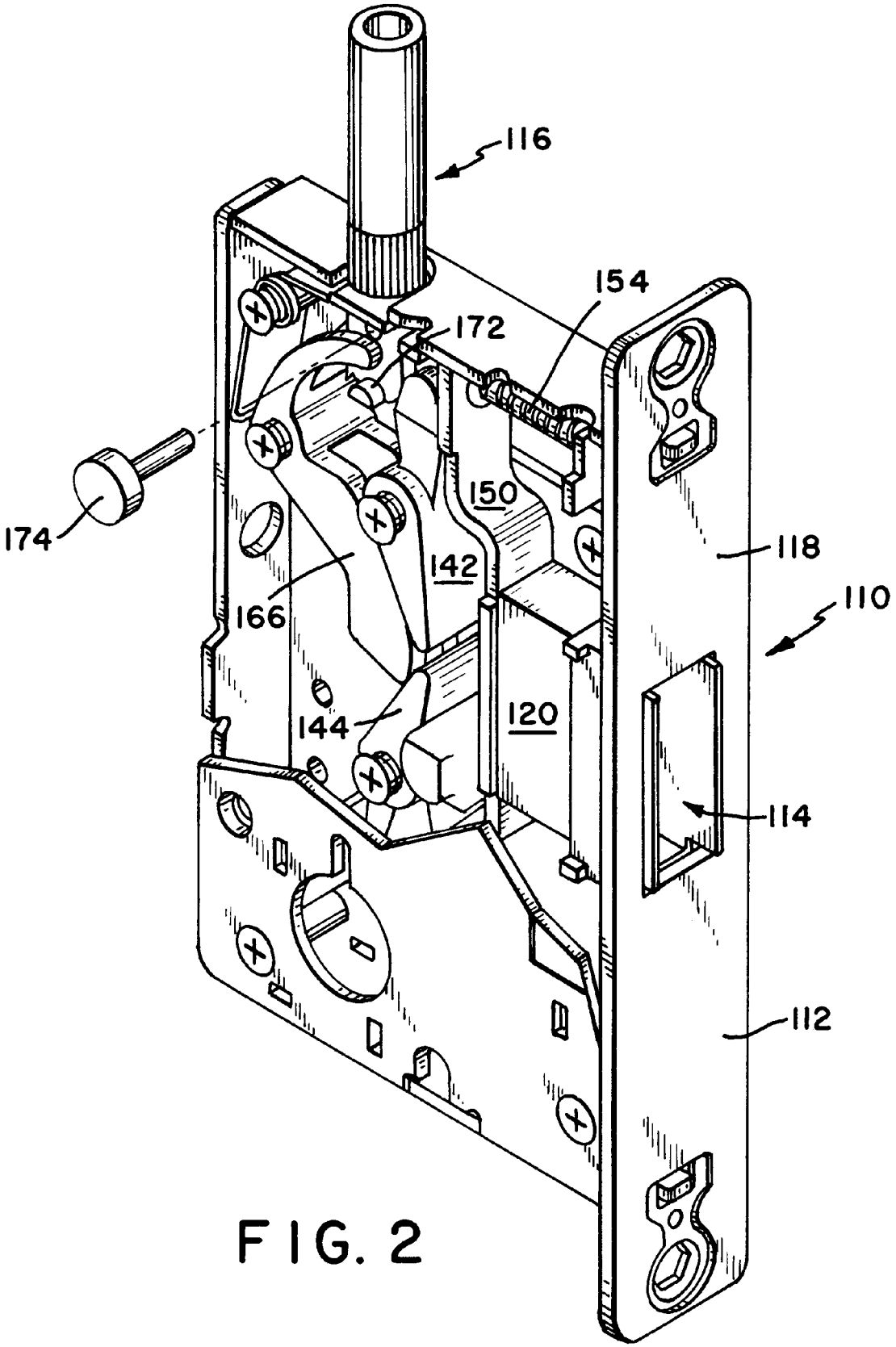
FIG. 2 is a perspective view of a passive mortise latch mechanism according to the present invention showing the mechanism in an embodiment having a single upper vertical rod. A portion of the front wall of the case has been cut away for clarity as in FIG. 1. The mechanism is shown with the door closed and handle not actuated, i.e., with the pusher slide in the receiving position for receiving the extended latch bolt of the active mortise latch of FIG. 1 and with the upper rod extended.

FIGS. 1 and 2 provide perspective views of one embodiment of the active 10 and passive 110 mortise latches of the present invention. The latches shown are adapted for use with only the upper vertical rods, but are otherwise identical to the embodiments shown in FIGS. 3–6 where lower vertical rods and associated mechanisms are also shown. The active and passive mortise latches of FIGS. 1 and 2 are intended for installation in corresponding active and passive double doors (not shown) that are oppositely hinged such that the lock faces 12, 112 on the latches face each other.

With the double doors both closed, the latch bolt 14 in the active mortise lock 10 engages the opening 114 in the passive mortise lock 110 to provide a center latch point between the two doors. Upper latch points are provided by conventional vertical rods that extend upward from vertical rod mounts 16, 116 to corresponding vertical rod latches (not shown) at the top of the door. The vertical rod latches engage strikes set in the door frame above the door. The vertical rod latches used are of the ratcheting type that hold the vertical rod retracted when the door is open, then release again as the door is closed. Suitable vertical rod latches are of the type found in U.S. Pat. No. 5,531,492 issued to the assignee of this invention on Jul. 2, 1996.

The lock mechanisms of the active and passive mortise locks are designed to cooperate so that either door may be opened first, and either door may be closed first. To achieve this functionality, the latch bolt 14 must be moved to the retracted position whenever the two doors are moving past each other, regardless of which of the two doors is being opened or closed. The cooperation necessary is accomplished principally through the use of an activation bolt 18 which contacts the face 112 above opening 114 on the passive lock approximately at the point marked with reference number 118 (the blocking face portion) when the doors are closed.

Figure 3:
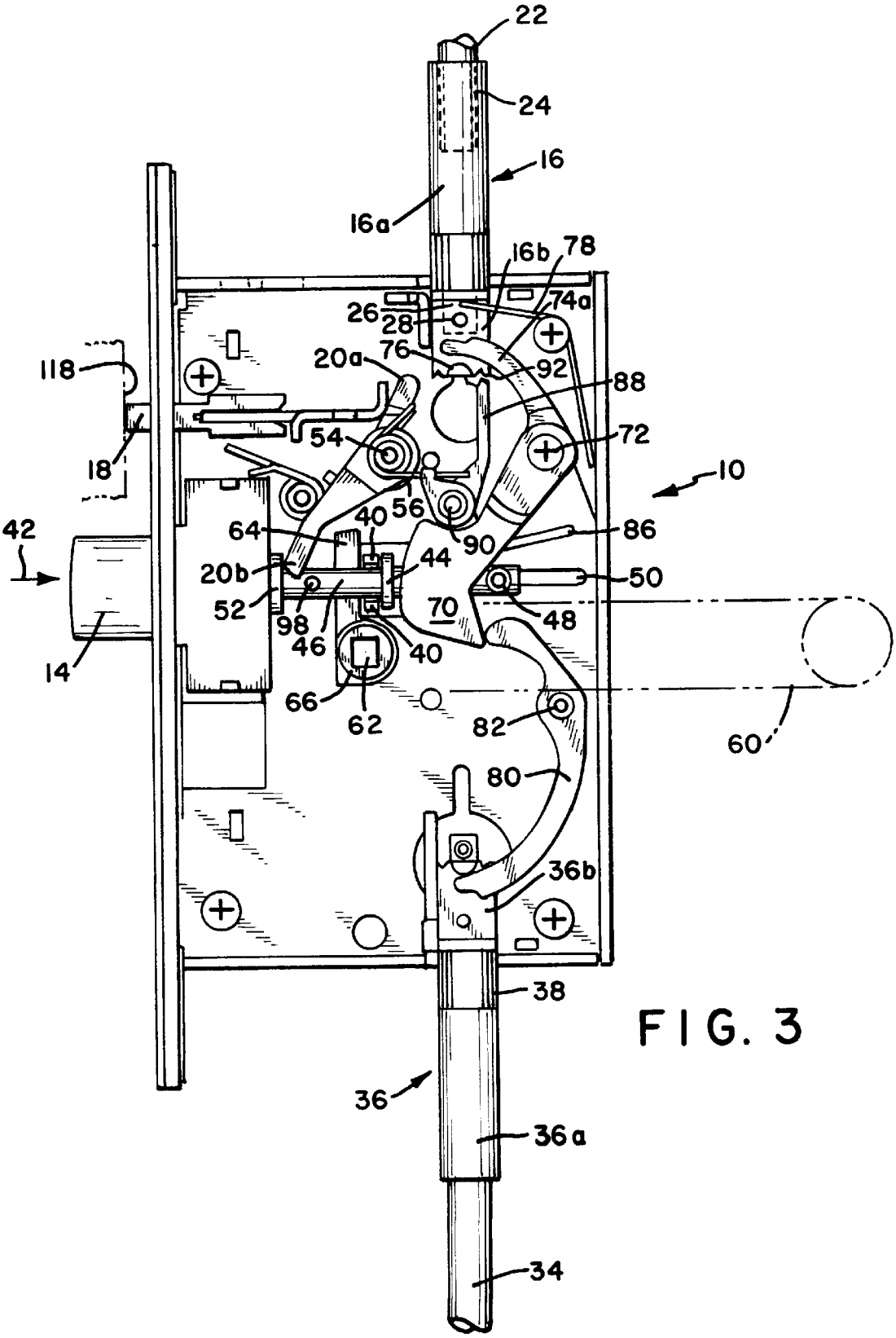
FIG. 3 is a front elevational view of the active mortise latch mechanism of FIG. 1 except that the front wall of the case has been completely removed and a lower rod and lower rod actuating components have been added in this embodiment. The mechanism is illustrated in the same condition as in FIG. 1, i.e., with the door closed.
Figure 5:
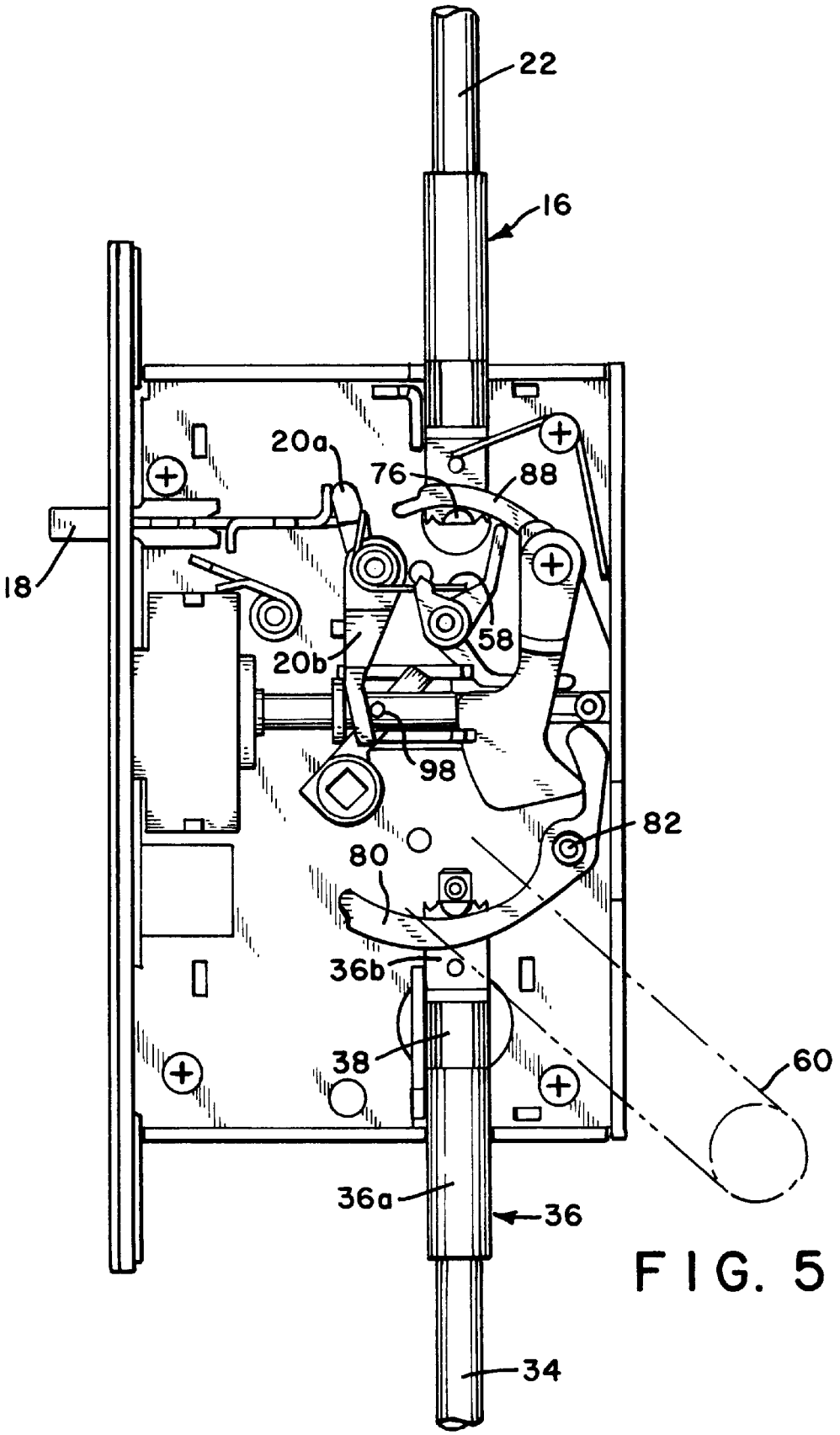
FIG. 5 is a front elevational view of the active mortise latch mechanism of FIG. 3 showing the handle actuated with the door opened.

Activation bolt 18 is spring loaded towards the extended position (FIG. 5 shows it extended) and is connected to the latch bolt 14 via a retractor having two halves 20*a* and 20*b* (see FIG. 3). The retractor interconnects the two bolts so that they move in opposition to each other. The retractor extends the latch bolt when the activation bolt is retracted and retracts the latch bolt when the activation bolt extends. When the doors are closed, activation bolt 18 is held in the retracted position (FIGS. 1 and 3 show it retracted) by the blocking face portion 118 which prevents the activation bolt 18 from extending. When either door is open, face portion 118 will no longer block the activation bolt 18, and it will extend to the position of FIG. 5, causing the latch bolt to retract.

In order to open either door, the center latching point must be unlatched by retracting the latch bolt 14 from opening 114 in the case of the passive mortise lock and by retracting the associated upper vertical rod (as well as the lower vertical rod, if installed). In the active mortise latch mechanism, the latch bolt 14 and vertical rod mount 16 are retracted by a handle mounted on the face of the door.

In the passive mortise latch mechanism, a pusher slide 120 operated by a handle on the passive door is used to eject the latch bolt 14 from opening 114. The handle also retracts the vertical rod attached to vertical rod mount 116 so that the door can swing open. Because the latch bolt 14 must be retracted before the doors separate, it can be seen that when the doors are opening or closing, both the activation and latch bolts must be in the retracted condition at the same time, despite the efforts of the retractor to move them in opposition. That is the purpose of the two portions 20*a* and 20*b* of the retractor.

The two retractor pieces 20*a*, 20*b* normally move as one to retract one bolt as the other extends, but they are spring loaded relative to each other so that the latch bolt 14 may be retracted by the active mortise latch, or ejected by the passive mortise latch when the activation bolt is still retracted. Alternatively, when closing the doors to bring them back into alignment, the relative motion of retractor pieces 20*a*, 20*b* allows the activation bolt to be pushed back into the retracted position as either door is closed, even while the latch bolt is still retracted.

Referring now to FIGS. 1, 3 and 5, the elements of the active mortise lock which provide the above described operation will be discussed in detail. The active mortise latch 10 is conventionally mortised into the active door of the double doors. The term "active door" is used to indicate that this door has the active mortise latch mechanism, i.e., the latch mechanism having the extending latch bolt rather than the receiving opening for that bolt, but does not otherwise indicate that the active door is any more usable than the passive door to be described. Both the active and passive doors are equally usable for normal passage through them.

It will be noted from FIG. 1 that the latch bolt has the general shape and configuration of a deadbolt and does not include angled surfaces intended to contact a strike plate on the opposing passive mortise latch mechanism as is needed for other latch bolt designs. Instead, the latch bolt is retracted by the spring extension of the activation bolt. This dead bolt type of shape makes it difficult to make an unauthorized entry by forcing the latch bolt back into the mortise mechanism. The front surface of the latch bolt is a push surface which is substantially perpendicular to the axis of the latch bolt. This push surface is used by the passive mortise latch to eject the latch bolt from latching engagement when the passive door is being used.

Upper vertical rod 22 is attached via threads 24 to upper vertical rod mount 16 in the active mortise latch. The upper vertical rod mount 16 includes an upper portion 16*a* and a lower portion 16*b*. The upper portion 16*a* includes a projecting cylindrical end 26 that extends into a corresponding cylindrical opening in the lower portion 16*b*. The projecting end 26 and the lower portion 16*b* have mating holes, shown in alignment and referenced with reference number 28 in FIG. 3.

The upper portion 16*a* and lower portion 16*b* of the vertical rod mount are held together by pin 30 (see FIG. 1). By removing pin 30, the upper portion 16*a,* which is provided with a knurled or ridged surface 32 can be rotated relative to the lower portion, or the two portions may be separated completely. Rotating the upper portion 16*a* relative to the lower portion in one direction causes the upper vertical rod 22 to be drawn towards the lock, while rotating it in the opposite direction causes the vertical rod 22 to be extended away from the lock. This allows the length of the vertical rod 22 to be adjusted whereupon the pin 30 is re-inserted into the aligned holes 28 to prevent further rotation and to securely connect the upper portion 16*a* to the lower portion 16*b*.

If the lock is to be provided with a lower rod, such as lower rod 34 in FIG. 3, a corresponding lower vertical rod mount 36 is provided which includes corresponding portions 36*a* and 36*b* pinned together in the same manner as described above. The lower vertical rod mount 36 also includes a knurled or ridged portion 38 corresponding to portion 32 on the upper vertical rod mount. This surface makes it easy to rotate the portions 16*a* or 36*a* as necessary to achieve the desired adjustment of the corresponding vertical rods 22, 34.

The active mortise latch mechanism 10 may be operated by either of two handles. One side of the door, generally the interior door, is provided with a conventional push bar or push rail type of handle. This type of handle is operated by pressure on the handle towards the door and is thus suitable for use in emergency situations where a large crowd of people may be pressed against the door. A conventional push handle of this type is provided with a forked operating member or arm projecting into the mortise lock through the surface of the door. The operating end of this member can be seen in FIG. 3 and is marked with reference number 40. Inward pressure on the push handle causes the operating member 40 and latch bolt 14 to move in the direction indicated with arrow 42. The forked end 40 of the operating member engages collar 44 formed on the tail 46 of the latch bolt 14 retracting the latch bolt.

The latch bolt tail 46 includes a guide 48 moving in slot 50. A second collar 52 on latch bolt tail 46 contacts portion 20*b* of the retractor which is pivotally mounted on pivot 54. The motion of latch bolt 14, and in particular collar 52, causes retractor piece 20*b* to rotate about pivot 54. Portion 20*b* is connected to portion 20*a* by a torsion spring 56 which tends to keep portion 20*b* in the relative position to portion 20*a* illustrated in FIGS. 1 and 3.

Portion 20*a* is connected to the case via a second retractor spring 58 which acts as an activation bolt spring and tends to drive the activation bolt 18 to the extended position. However, as illustrated in FIG. 3, when the doors are closed, the activation bolt 18 is blocked by surface 118. This surface may be on the passive mortise latch mechanism, or it may be part of the door frame in a single door installation. In this condition, retractor portion 20*a* cannot move due to the blocking action of surface 118 and retractor portion 20*b* pivots relative to portion 20*a,* compressing spring 56 as the operating member fork 40 on the push handle moves to the rear (i.e. direction 42).

The retraction of latch bolt 14 can be accomplished either through the motion of the operating member 40 of an interior push handle operating against collar 44 on the tail 46, or it may be initiated by a rotating handle such as handle 60 illustrated in phantom located on the exterior surface of the door. Handle 60 is provided with a square spindle engaging square spindle opening 62 in latch bolt retractor finger element 64. The latch bolt retractor finger element includes a finger portion marked with reference number 64 and a cylindrical portion marked with reference number 66 surrounding square opening 62.

The cylindrical portion 66 extends between opposite surfaces of the mortise lock which have corresponding circular openings acting as bearings for the rotational action of the latch bolt retractor finger 64. Rotating handle 60 downward causes finger 64 to contact the operating member 40 which drives the latch bolt 14 in direction 42, to operate the latch substantially as described for the operation of the push handle.

Motion of the latch bolt 14 in direction 42 causes vertical rod retracting link 70 to pivot about pivot 72. This draws the upper hooked portion 74 of retracting lever 70 downwards. The hooked portion 74 is forked having a pair of arcuate tines 74*a* and 74*b* located on opposite sides of portion 16*b* of the upper vertical rod mount 16.

As can be seen best in FIG. 1, portion 16*b* of the upper vertical rod mount includes a pair of projections 76 located under the corresponding arcuate tines 74*a*and 74*b* such that as member 70 pivots and draws the tines downwards, the projections 76 are engaged and also drawn down to retract the upper vertical rod mount 16 and corresponding upper vertical rod 22. The upper vertical rod mount 16 is spring loaded with upper vertical rod mount spring 78 so that it is constantly urged towards the extended position.

If a lower vertical rod mount is provided, such as the lower vertical rod mount 36 in FIG. 3, then a corresponding lower vertical rod retractor link 80 is mounted onto pivot 82 and is driven in a corresponding manner by lever 70 to draw the lower vertical rod up simultaneously with the retraction of the center latch 14 and the upper vertical rod mount 16.

As the latch bolt 14 retracts, the portion of the upper vertical rod retractor link 70 that is below pivot 72 will swing down and into contact with arm 86. Arm 86 is part of guard lever 88 mounted on pivot pin 90. The downward motion of arm 86 causes the guard lever arm 88 to move out from underneath notch 92 in the bottom surface of the lower portion 16*b* in the upper vertical rod mount 16. This allows the vertical rod to be retracted by the upper vertical rod retractor link 70. The guard lever 88 otherwise prevents the vertical rod 22 from being manipulated downwards except when the handle is properly operating the latch mechanism and retracting the latch bolt.

From the description above it will be seen that rotation of handle 60 or operation of the push handle will retract the latch bolt 14 and the vertical rods while the activation bolt 18 remains retracted due to the blocking action of surface 118. The door can then be opened, at which point activation bolt 18 will extend under the influence of retractor portion 20*a* and spring 58. This condition is seen in FIG. 5. As either handle is released, the mechanism will remain with activation bolt 18 extended and latch bolt 14 retracted. Vertical rods 22 and 34 will also remain retracted by the operation of the ratcheting vertical rod latches (not shown). FIG. 5 illustrates guard lever 88 in its released position with the upper vertical rod mount 16 retracted.

As the activation bolt 18 is extended by retractor lever 20*a,* the opposite end 20*b* of the retractor lever contacts pin 98 in the latch bolt tail and retracts the latch bolt. The latch bolt remains retracted until the doors are closed, which they are now free to do without interference from the latch bolt. As the doors come into alignment, the angled surface of the activation bolt will allow it to be pushed back to the retracted position, moving portion 20*a* to the position shown in FIG. 3. This will allow the latch bolt to extend, but until the doors are fully aligned, the latch bolt 14 cannot extend into opening 114. During this interval, the second portion 20*b* of the retractor will remain in the position shown in FIG. 5. As soon as the doors are fully aligned, however, the retractor spring will return portion 20*b* to the position shown in FIG. 3 and extend the latch bolt.

Figure 4:
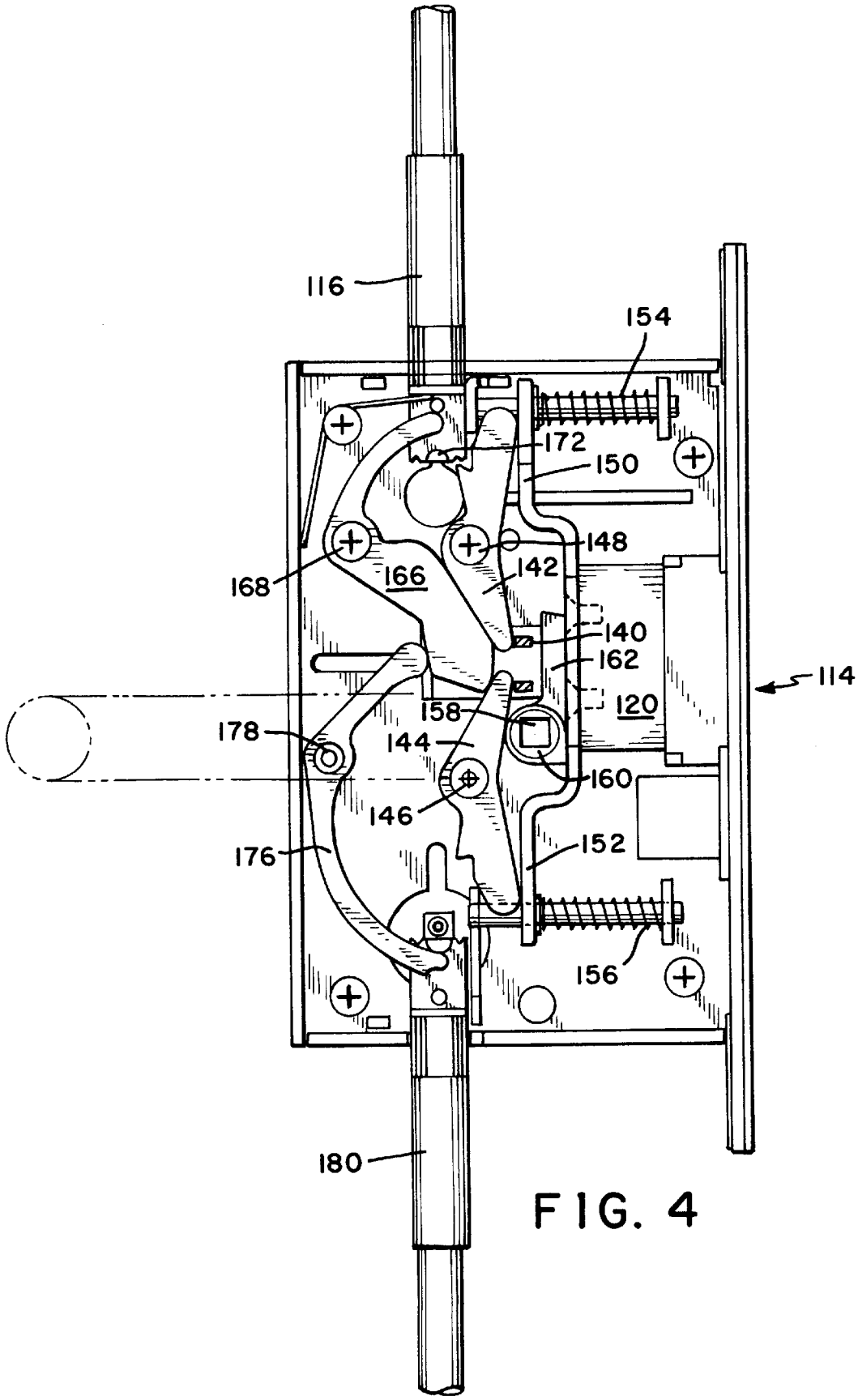
FIG. 4 is a front elevational view of the passive mortise latch mechanism of FIG. 2 except that the front wall of the case has been completely removed and a lower rod and lower rod actuating components have been added in this embodiment. The mechanism is illustrated in the same condition as in FIG. 2.
Figure 6:
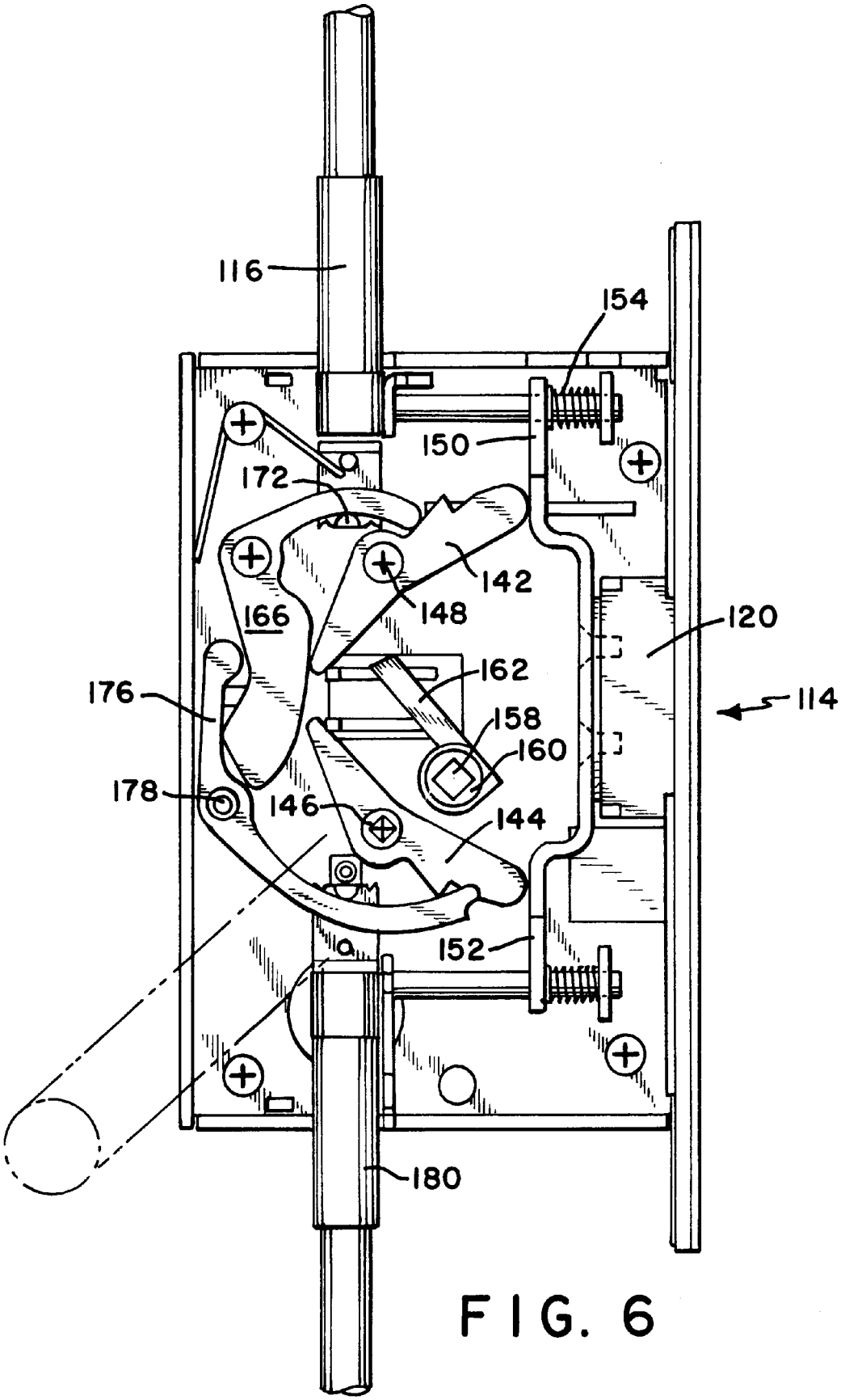
FIG. 6 is a front elevational view of the passive mortise latch mechanism of FIG. 4 showing the handle actuated with the door opened.

Referring now to FIGS. 2, 4 and 6 the operation of the passive mortise latch mechanism will be described. The passive mortise latch mechanism uses a pusher slide 120 that moves from a receiving position (FIGS. 2 and 4) that allows the latch bolt to enter opening 114 to an ejecting position (FIG. 6) that ejects the latch bolt from opening 114.

The passive mortise latch mechanism is significantly different from the active mortise latch mechanism, just described. However, the push handle and its operating member 140 (see FIG. 4) which drives the passive mortise latch mechanism, as well as the vertical rod components in the passive door, are essentially identical to the corresponding components described in connection with the active mortise latch.

Operating member 140 includes a forked end that protrudes through the surface of the passive door and into the passive mortise latch mechanism 110 through an opening in the case thereof as described in connection with the active latch. The forked end of the operating member 140 contacts a pair of pivot arms 142, 144 and moves them between the position shown in FIGS. 2 and 4 to the position shown in FIG. 6.

FIGS. 2 and 4 show the pivot arms in the normal non-operated positions. These are the positions they have when the passive door is not actually being opened and neither handle has been operated on the passive door. When the passive door is being opened, operating member 140 moves to the position shown in FIG. 6 and pivots the pivot arms 142, 144 about pivots 146, 148.

This pivoting action drives the pusher slide 120 to the ejecting position and pushes against the push surface at the end of the latch bolt 14, pushing the latch bolt out of opening 114. The pusher slide 120 is mounted on slide arms 150, 152. The slide arms are spring loaded to the left in FIGS. 2, 4 and 6 with pusher springs 154, 156. The pusher springs hold the pusher slide 120 in the receiving position (FIGS. 2 and 4) which keeps opening 114 unobstructed whenever the handles are not actively being depressed or rotated to the open position.

As is the case with the active door, the passive door is preferably provided with a push handle on the interior, having the forked operating member 140, and a rotating handle on the exterior. The exterior rotating handle is provided with a square spindle that engages spindle hole 158 in cylindrical portion 160 of the passive finger element 162. Finger element 162 cooperates with the forked end of the handle operating member 140 in the passive latch in exactly the way that the retractor finger element 64 cooperates with the forked end 40 in the active latch. The cylindrical portion 160 is carried in openings in opposite faces of the passive latch that act as bearings as also described in connection with the active latch.

Regardless of whether the pivot arms 142, 144 are moved directly by the push handle and the operating member 140 connected thereto or indirectly by the rotation of finger element 162, the pivot arms will contact and rotate the vertical rod retractor link 166 about pivot point 168. The upper vertical rod retractor link 166 in the passive latch mechanism engages the upper vertical rod mount 116 which is identical to the upper vertical rod retractor mount in the active latch mechanism.

The upper vertical rod retractor link 166 is provided with a pair of arcuate tines that are positioned on opposite sides of the lower end of the upper mount 116. The tines engage a pair of protrusions 172 on the lower end of the upper mount 116 as previously described for the active mortise latch. The upper mount is provided with an upper end and a lower end that are held together with pin 174.

When a lower vertical rod is desired, the lower vertical rod retractor link 176 is installed on pivot 178. The rotation of the upper vertical rod retractor link 166 drives the lower vertical rod retractor link 176 to retract the lower vertical rod mount 180 in the same way described for the upper mounts and the option lower mount in the active mortise latch, i.e. by pulling the mount with a pair of arcuate tines that contact projections on the mount.

While the present invention has been particularly described in conjunction with a specific preferred embodiment, it is evident that many alternatives, modifications and variations will be apparent to those skilled in the art in light of the foregoing description. It is therefore contemplated that the appended claims will embrace any such alternatives, modifications and variations as falling within the true scope and spirit of the present invention.

Thus, having described the invention, what is claimed is:

1. An active mortise latch mechanism comprising:

a case;

a latch bolt mounted in the case for motion between an extended and a retracted position, the latch bolt being adapted for retraction by a handle;

an activation bolt mounted in the case for motion between an extended and a retracted position;

a retractor mounted in the case and connected between the latch bolt and the activation bolt to automatically retract the latch bolt whenever the activation bolt is extended;

an activation bolt spring, the activation bolt spring being connected to extend the activation bolt and automatically retract the latch bolt with the retractor whenever the activation bolt is not obstructed; and a vertical rod retractor link mounted within the case, the vertical rod retractor link being operably connected to the latch bolt to retract a vertical rod when the latch bolt moves to the retracted position.

2. The active mortise latch mechanism of claim 1 wherein the retractor includes first and second relatively movable portions, the first retractor portion moving the latch bolt and the second retractor portion moving the activation bolt, the relative motion allowing the latch bolt to be pushed to the retracted position when the activation bolt is also in the retracted position.

3. The active mortise latch mechanism of claim 2 further including a retractor spring operating between the first portion of the retractor and the second portion of the retractor.

4. The active mortise latch mechanism of claim 1 further including a vertical rod mount for connection to the vertical rod, the vertical rod retractor link engaging the vertical rod mount and retracting the vertical rod mount to retract the vertical rod when the latch bolt moves to the retracted position.

5. The active mortise latch mechanism of claim 4 wherein the vertical rod retractor link includes a fork for engaging and retracting the vertical rod mount.

6. The active mortise latch mechanism of claim 5 wherein the fork on the vertical rod retractor link includes a pair of arcuate tines acting on opposite sides of the vertical rod mount.

7. The active mortise latch mechanism of claim 6 wherein the vertical rod mount includes a pair of projections and the pair of arcuate tines slide on the pair of projections to retract the vertical rod mount.

8. The active mortise latch mechanism of claim 4 wherein the vertical rod mount includes a first end engaged by the vertical rod retractor link and a second end engaging the vertical rod.

9. The active mortise latch mechanism of claim 8 wherein the second end of the vertical rod mount is threaded for attachment to the vertical rod and is rotationally connected to the first end, the rotational connection allowing the second end to be rotated to adjust the vertical rod.

10. The active mortise latch mechanism of claim 9 further including a vertical rod adjustment lock for locking the first end of the vertical rod mount relative to the second end to retain an adjustment of the vertical rod.

11. The active mortise latch mechanism of claim 10 wherein the vertical rod adjustment lock comprises a pin extending through a portion of the first end of the vertical rod mount and engaging a portion of the second end of the vertical rod mount to prevent relative rotation of the first and second ends.

12. The active mortise latch mechanism of claim 9 wherein a portion of the second end of the vertical rod mount is at least partially covered with a gripping surface to aid in rotation of the second end relative to the first end.

13. The active mortise latch mechanism of claim 1 further including a latch bolt retractor finger rotationally attached to the case, the latch bolt retractor finger retracting the latch bolt when rotated.

14. The active mortise latch mechanism of claim 13 wherein the latch bolt includes a tail engageable by an operating member extending into the case from a push handle located on one side of the case and the latch bolt retractor finger is engageable by a shaft extending into the case from a rotary handle located on an opposite side of the case from the push handle.

15. The active mortise latch mechanism of claim 14 wherein the latch bolt tail is moveable by the operating member extending into the case from the push handle without moving the latch bolt retractor finger.

16. The active mortise latch mechanism of claim 15 wherein the latch bolt retractor finger contacts and moves the operating member which contacts and moves the tail when the latch bolt is retracted by the latch bolt retractor finger.

17. The active mortise latch mechanism of claim 1 further including a second vertical rod retractor link for retracting a second vertical rod, the second vertical rod retractor link being operably connected to the latch bolt to retract the second vertical rod when the latch bolt moves to the retracted position.

18. The active mortise latch mechanism of claim 17 wherein the second vertical rod retractor link is driven by the first vertical rod retractor link to retract the second vertical rod when the first vertical rod retractor link retracts the first vertical rod.

19. The active mortise latch mechanism of claim 17 further including a vertical rod mount for connection to the second vertical rod, the second vertical rod retractor link engaging the second vertical rod mount and retracting the second vertical rod mount to retract the second vertical rod when the latch bolt moves to the retracted position.

20. An active mortise latch mechanism according to claim 1 in combination with a passive mortise latch mechanism, the passive mortise latch mechanism comprising:

a case for the passive mortise latch mechanism;

an opening in the case of the passive mortise latch mechanism for receiving the latch bolt of the active mortise latch mechanism; and a pusher slide movable between receiving and ejecting positions, the pusher slide having a pusher surface for pushing and ejecting the latch bolt of the active mortise latch mechanism from the opening in the case of the passive mortise latch mechanism when the pusher slide is in the ejecting position.

21. The active mortise latch mechanism and passive mortise latch mechanism of claim 20, wherein the passive mortise latch mechanism further includes a vertical rod retractor link mounted within the passive case, the vertical rod retractor link in the passive case being operably connected to retract a passive vertical rod when the pusher slide moves to the ejecting position.

22. The active mortise latch mechanism and passive mortise latch mechanism of claim 21, wherein the passive mortise latch mechanism further includes:

at least one pusher slide spring connected to urge the pusher slide towards the receiving position; and an operating opening in the case of the passive mortise latch mechanism adapted to receive an operating member from a push handle.

23. The active mortise latch mechanism and passive mortise latch mechanism of claim 21, wherein the passive mortise latch mechanism further includes at least one pivot arm pivotally mounted to the case of the passive mortise latch mechanism, the pivot arm having a first end for operation by an operating member from a push handle located on one side of the passive case and a second end for operating the pusher slide.

24. The active mortise latch mechanism and passive mortise latch mechanism of claim 21, wherein the passive mortise latch mechanism includes two pivot arms pivotally mounted to the case of the passive mortise latch mechanism, each pivot arm having a first end for operation by an operating member from a push handle located on one side of the passive case and a second end for operating the pusher slide, the pivot arms being pivotally mounted to the case of the passive mortise latch mechanism on opposite sides of the operating opening.

25. An active mortise latch mechanism comprising:

a case;

a latch bolt mounted in the case for motion between an extended and a retracted position, the latch bolt having a tail adapted for motion by an operating member extending into the case from a push handle located on one side of the case;

an activation bolt mounted in the case for motion between an extended and a retracted position;

a retractor mounted in the case and connected between the latch bolt and the activation bolt to retract the latch bolt when the activation bolt is extended;

an activation bolt spring, the activation bolt spring being connected to extend the activation bolt and automatically retract the latch bolt with the retractor whenever the activation bolt is not obstructed;

a vertical rod mount for connection to a vertical rod, the vertical rod mount being adjustable to adjust the vertical rod; and a vertical rod retractor link pivotally mounted within the case, an end of the vertical rod retractor link being driven by the operating member when the latch bolt is retracted and an opposite end of the vertical rod retractor link retracting the vertical rod mount to retract the vertical rod.

26. A double door latching system(for latching active and passive doors, the double door latching system comprising:

an active mortise latch mechanism for mounting in the active door, the active mortise latch mechanism including:

an active case;

a latch bolt mounted in the case, the latch bolt retracting when the active and passive doors are not in alignment and extending when the active and passive doors are aligned, and a vertical rod retractor link, mounted in the active case, and adapted to retract a vertical rod when the latch bolt is retracted;

a push handle mechanism, adapted for mounting on the active door, the push handle mechanism including an operating member being operatively connected to the active mortise latch mechanism to retract the latch bolt;

a passive mortise latch mechanism for mounting in the passive door, the passive mortise latch mechanism including:

a passive case, an opening in the passive case for receiving the latch bolt of the active mortise latch mechanism, a pusher slide movable between receiving and ejecting positions, the pusher slide having a pusher surface for pushing and ejecting the latch bolt of the active mortise latch mechanism from the opening in the case of the passive mortise latch mechanism when the pusher slide is in the ejecting position, and vertical rod retractor link, mounted in the passive case, and adapted to retract a vertical rod when the pusher slide is moved to the ejecting position; and a second push handle mechanism, adapted for mounting on the passive door, the second push handle mechanism including an operating member being operatively connected to the passive mortise latch mechanism to move the pusher slide to the ejecting position.

27. A double door latching system according to claim 26, wherein the active and passive mortise latch mechanisms each include a single vertical rod corresponding to and operated by the corresponding vertical rod retractor links.

28. A double door latching system according to claim 27, wherein the active and passive mortise latch mechanisms further include corresponding adjustable vertical rod mounts connected between the vertical rods and the corresponding vertical rod retractor links.

29. A double door latching system according to claim 26, wherein the active mortise latch mechanism further includes an activation bolt movable between an extended and a retracted position, the activation bolt contacting the passive mortise latch mechanism when the active and passive doors are aligned to move the activation bolt to the retracted position and move the latch bolt to the extended position.

30. A double door latching system according to claim 29 wherein the active mortise latch mechanism further includes a retractor pivotally connected between the latch bolt and the activation bolt to retract the latch bolt when the activation bolt is extended.

31. A double door latching system according to claim 30 wherein the retractor includes first and second relatively movable portions, the first retractor portion moving the latch bolt and the second retractor portion moving the activation bolt.

32. A double door latching system according to claim 31 further including a retractor spring to extend the activation bolt and retract the latch bolt when the active and passive doors are not in alignment.

* * * * *